US006422151B2

(12) United States Patent
Maleika

(10) Patent No.: US 6,422,151 B2
(45) Date of Patent: Jul. 23, 2002

(54) TOY CAR WITH ADJUSTABLE MAGNETIC ADHESION

(75) Inventor: Hubertus Maleika, Cadolzburg-Wachendorf (DE)

(73) Assignee: STS Racing GmbH, Nürnberg (DE)

( * ) Notice: Subject to any disclaimer, the term of this patent is extended or adjusted under 35 U.S.C. 154(b) by 0 days.

(21) Appl. No.: 09/770,954

(22) Filed: Jan. 26, 2001

(30) Foreign Application Priority Data

Jan. 27, 2000 (DE) ..... 100 03 557

(51) Int. Cl.[7] ..... A63H 18/12

(52) U.S. Cl. ..... 104/53; 104/293; 104/295; 105/73; 105/77; 105/1.5; 446/465

(58) Field of Search ..... 104/53, 293, 295; 105/73, 78, 76, 77, 1.5, 157.2; 446/465

(56) References Cited

U.S. PATENT DOCUMENTS 4,171,592 A * 10/1979 Saitoh ..... 446/456
4,471,566 A * 9/1984 Ishimoto ..... 446/129
4,940,444 A * 7/1990 Russell ..... 446/446
5,167,563 A * 12/1992 Saffer ..... 446/465
5,916,007 A * 6/1999 Maxim ..... 446/130

FOREIGN PATENT DOCUMENTS

DE 32 40 712 11/1982
DE 33 27 667 7/1983
DE 3240712 C2 * 5/1984

* cited by examiner

*Primary Examiner*—S. Joseph Morano
*Assistant Examiner*—Frantz F. Jules
(74) *Attorney, Agent, or Firm*—Collard & Roe, P.C.

(57) ABSTRACT

The invention relates to a toy car with adjustable magnetic adhesion for an auto racetrack having ferromagnetic current conductors countersunk in the roadbed. The conductors are in active communication with a permanent magnet countersunk in the chassis of the toy car. The permanent magnet is shiftable in the chassis along an inclined plane in order to adjust the clearance between permanent magnet and the current conductors. According to the invention, the permanent magnet can be shifted along a ferromagnetic holding plate oriented at an angle relative to the roadway plane. The plate is received in a retaining means formed in one piece with the chassis. The underside of the retaining means contains two guide rails, along which the permanent magnet can be shifted.

4 Claims, 6 Drawing Sheets

TOY CAR WITH ADJUSTABLE MAGNETIC ADHESION

BACKGROUND OF THE INVENTION

1. Field of the Invention

The invention relates to a toy car with adjustable magnetic adhesion for a racetrack.

2. The Prior Art

Toy cars of this type are driven by an electric motor, which draws its supply current via sliding brushes, which are in contact with current conductors of the roadbed. These current conductors are usually ferromagnetic and, via a permanent magnet in the toy car, increase the adhesion thereof to the roadbed during running.

German Patent 3327667 discloses a toy car with magnetic adhesion for an auto racetrack. This car contains vertically adjustable permanent magnets, in which the clearance between the permanent magnets and current conductors is adjustable with spacer plates. The holders of the permanent magnets and of the spacer plates are fastened with screws, which also connect the undercarriage and body.

Because of the need to use spacer plates, adjusting the clearance between the permanent magnet and current conductor is a complex process. Thus, it cannot be accomplished during normal operation of the toy.

German Patent 3240712 C2 describes a toy car with magnetic adhesion for an auto racetrack, in which the permanent magnet is disposed in a magnet holder mounted adjustably on the undercarriage. The height of the gap between the permanent magnet and current conductors can be adjusted. For this purpose, the magnet holder can also be disposed on an inclined plane, which is adjustable on a correspondingly inclined plane in the undercarriage. Adjustment is accomplished by a slide, which is provided with collapsible hook attachments, which are braced against a toothed rod disposed on the undercarriage. The magnet holder can also be mounted in a shaft disposed on the undercarriage and can be provided with an inclined guide groove, which slides on an inclined guide tongue.

The arrangement in which a magnet holder is used for holding and shifting the permanent magnet is technically complex, susceptible to malfunctions and associated with high costs.

SUMMARY OF THE INVENTION

It is therefore an object of the invention to provide a toy car with adjustable magnetic adhesion for an auto racetrack, which is of simpler design than in the prior art but nevertheless offers infinitely variable adjustment capability, is inexpensive to produce and is not susceptible to malfunctions.

In the toy car according to the invention, the permanent magnet can be shifted along guide rails of the chassis oriented at an incline relative to the roadbed plane. The guide rails are formed along the sides in a retaining means made in one piece with the chassis. The inside of the retaining means on the side of the permanent magnet opposite the roadbed contains a ferromagnetic adhesion plate disposed parallel to the guide rails, along which plate the permanent magnet can be shifted infinitely variably.

The permanent magnet's retaining means, which has a substantially rectangular cross section, can be made in one piece with the bottom plate, so that no additional structural part is necessary. Because the permanent magnet adheres to a metal adhesion plate, it can be pushed thereon into any desired position, while at the same time no additional holding device is necessary to lock a shift position.

Preferably, the retaining means is located in the chassis between drive motor and front axle. Thus, the permanent magnet is located substantially at the center of gravity of the toy car, in which case the running characteristic and simultaneously the contact pressure can be varied by shifting the permanent magnet. Preferably, the inclined plane of the adhesion plate on which the permanent magnet can be shifted is constructed so that the smallest contact pressure occurs in a position of the permanent magnet close to the front axle of the car, while the highest contact pressure can be achieved by shifting the position close to the drive motor.

In order to immobilize the adhesion plate in the retaining means, the retaining means is provided with a front holding nose, which can engage the adhesion plate from behind. Simultaneously, the holding nose can limit the displacement distance of the permanent magnet and prevent removal thereof from the retaining means.

The permanent magnet is adjustable along the inclined plane by manual action from the underside of the chassis. Thus, further auxiliary shifting means are not needed.

In order to offer the user the capability of adjusting specific positions of the permanent magnet, the guide rails can contain one or more inwardly directed projections, or the adhesion plate can be provided with transversely directed raised structures, which represent a certain resistance or stop in a particular position during shifting of the permanent magnet.

The permanent magnet is constructed as a one-piece rectangular plate. In an improved embodiment, however, the permanent magnet can also be of two-piece structure, making it possible to spread the contact pressure of the permanent-magnet parts on the roadbed over a larger surface and to achieve even finer adjustment of the contact pressure by pushing the parts of the magnet away from one another.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
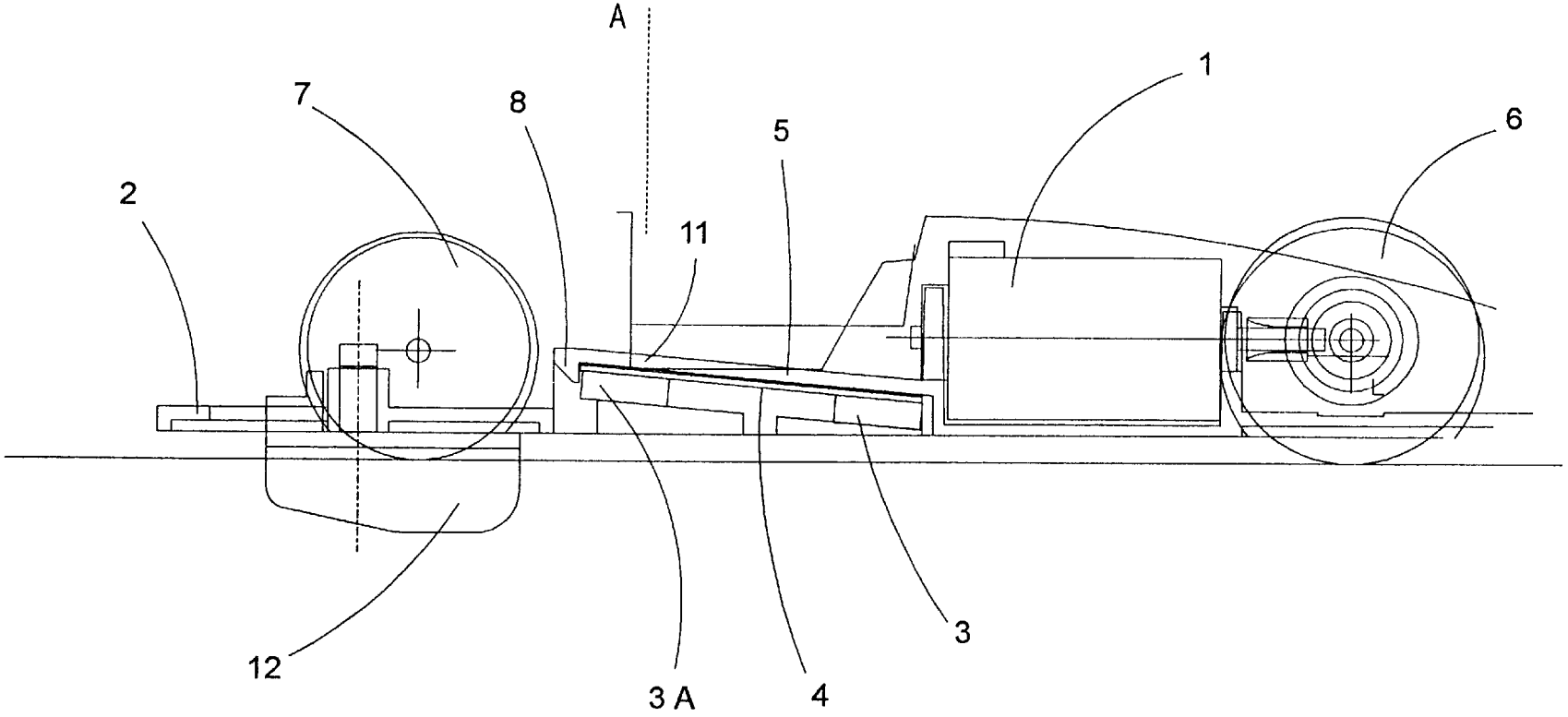
FIG. 1 shows a side view of a toy car according to the invention.

The toy car illustrated in FIG. 1 contains a pair of driving wheels 6 as well as front wheels 7 fastened in a chassis 2. Driving wheels 6 are driven by a motor 1 disposed in a longitudinal direction of the toy car. The toy car runs on a racetrack, which is provided with countersunk ferromagnetic current conductors. There is a recess between the conductors in which there engages a guide key 12 of the toy car, thus ensuring lateral guidance.

The toy car illustrated in FIG. 1 is provided in its middle region between motor 1 and front wheels 7 with a retaining means 5 of rectangular cross section and triangular longitudinal section. Retaining means 5 is formed in one piece with chassis 2. This is oriented at an acute angle relative to chassis 2 and the roadway, with the slope ascending toward the front.

Retaining means 5 is designed to receive an adhesion plate 4, which covers the inside of retaining means 5. Adhesion plate 4 is ferromagnetic, so that a magnet 3 placed in the retaining means adheres firmly but slidably to adhesion plate 4. Permanent magnet 3, which is designed as a rectangular plate, can be shifted infinitely variably along adhesion plate 4 between a rear position and a front position. The symbol 3A shows permanent magnet 3 in the front position. The clearance between permanent magnet 3 and the roadbed is as small as possible in its rear position, whereas the clearance of the permanent magnet in front position 3A represents the greatest distance from the roadbed. Since the attractive force of a magnet acting on a ferromagnetic body decreases exponentially with increasing distance, the intensity of the contact pressure of the car on the roadbed can in this way be adjusted within a broad range of variation.

Figure 2:
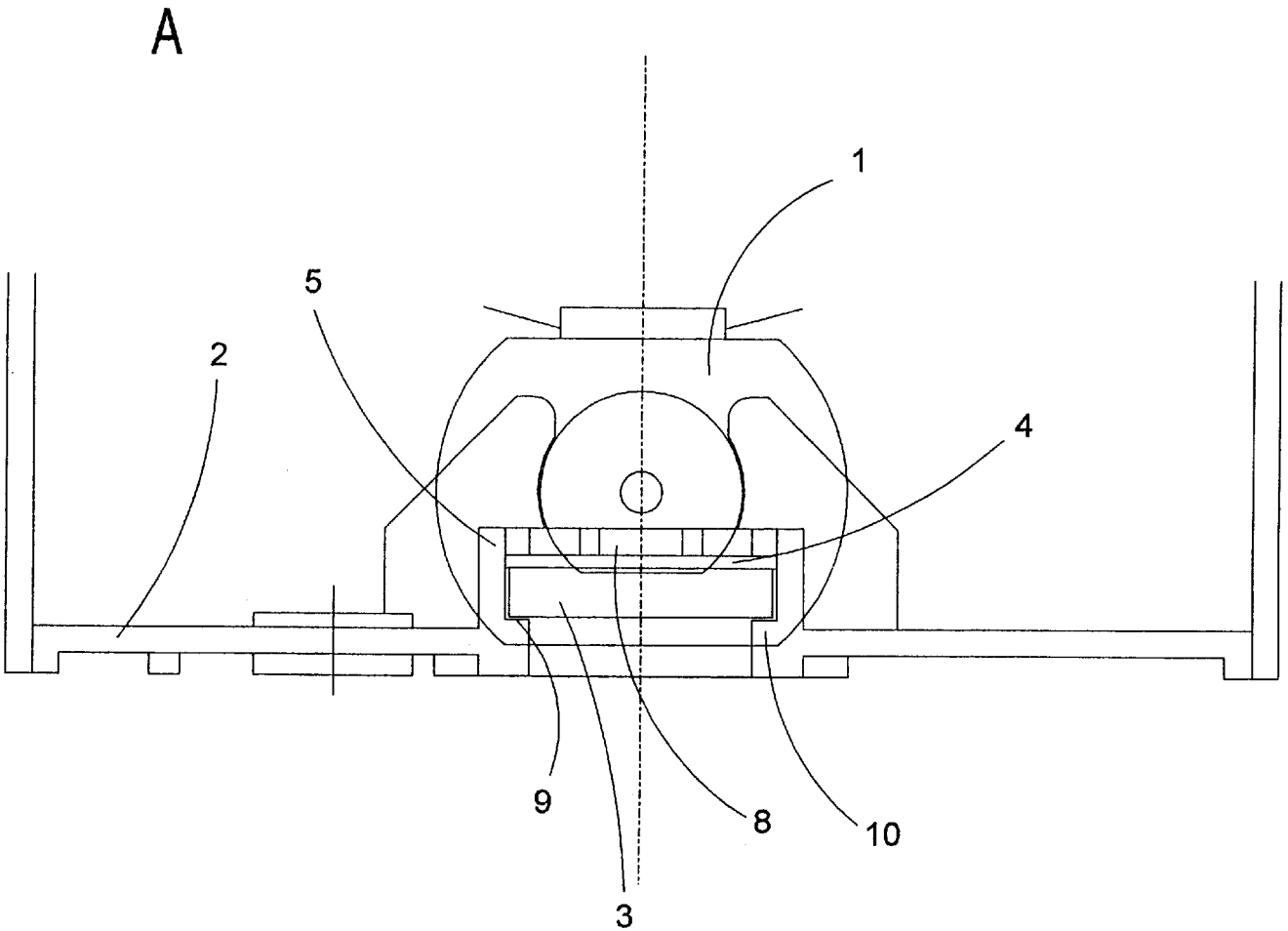
FIG. 2 shows a sectional view through a toy car along line A of FIG. 1.

FIG. 2 shows a sectional view through FIG. 1 along line A. Retaining means 5 is a part of chassis 2 that is upwardly open in the shape of a box. The underside of retaining means 5 is formed by inwardly directed guide rails 9, 10. On the inside upper surface there is disposed adhesion plate 4. Magnet 3 can be shifted between adhesion plate 4 and guide rails 9, 10. Shifting can be achieved manually by reaching into the retaining means from the underside of the vehicle.

Figure 3:
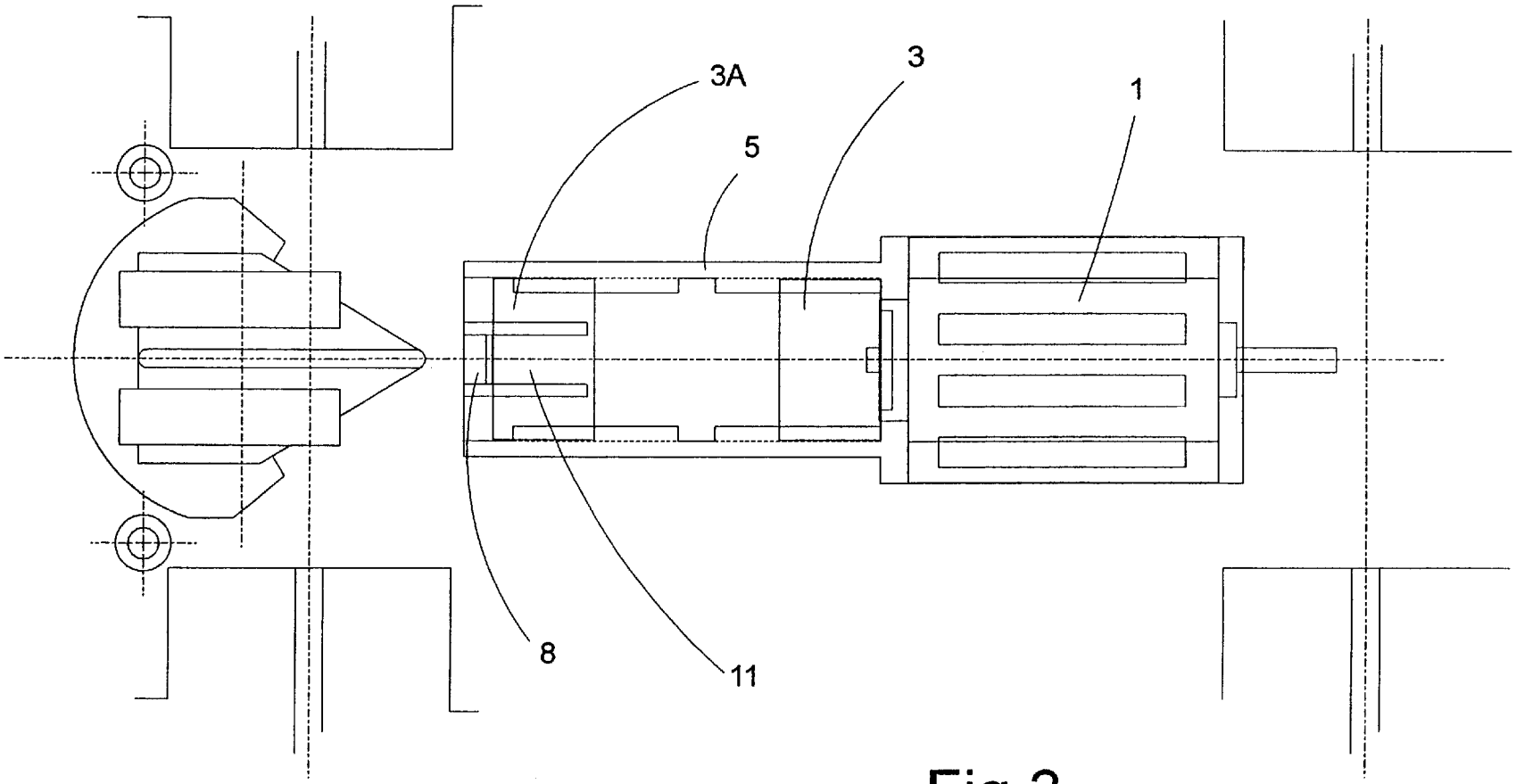
FIG. 3 shows a bottom view of the toy car according to FIG. 1.

FIG. 3 shows a bottom view of a toy car according to FIG. 1. Permanent magnet 3 is shown in the rear position as well as in front position 3A. In order to lock adhesion plate 4, there is provided a snap-in nose 8 attached to a strap 11 (see also FIG. 2). The snap-in nose extends sufficiently far into retaining means 5 that it also constitutes a sliding limit for permanent magnet 3 in position 3A.

Figure 4:
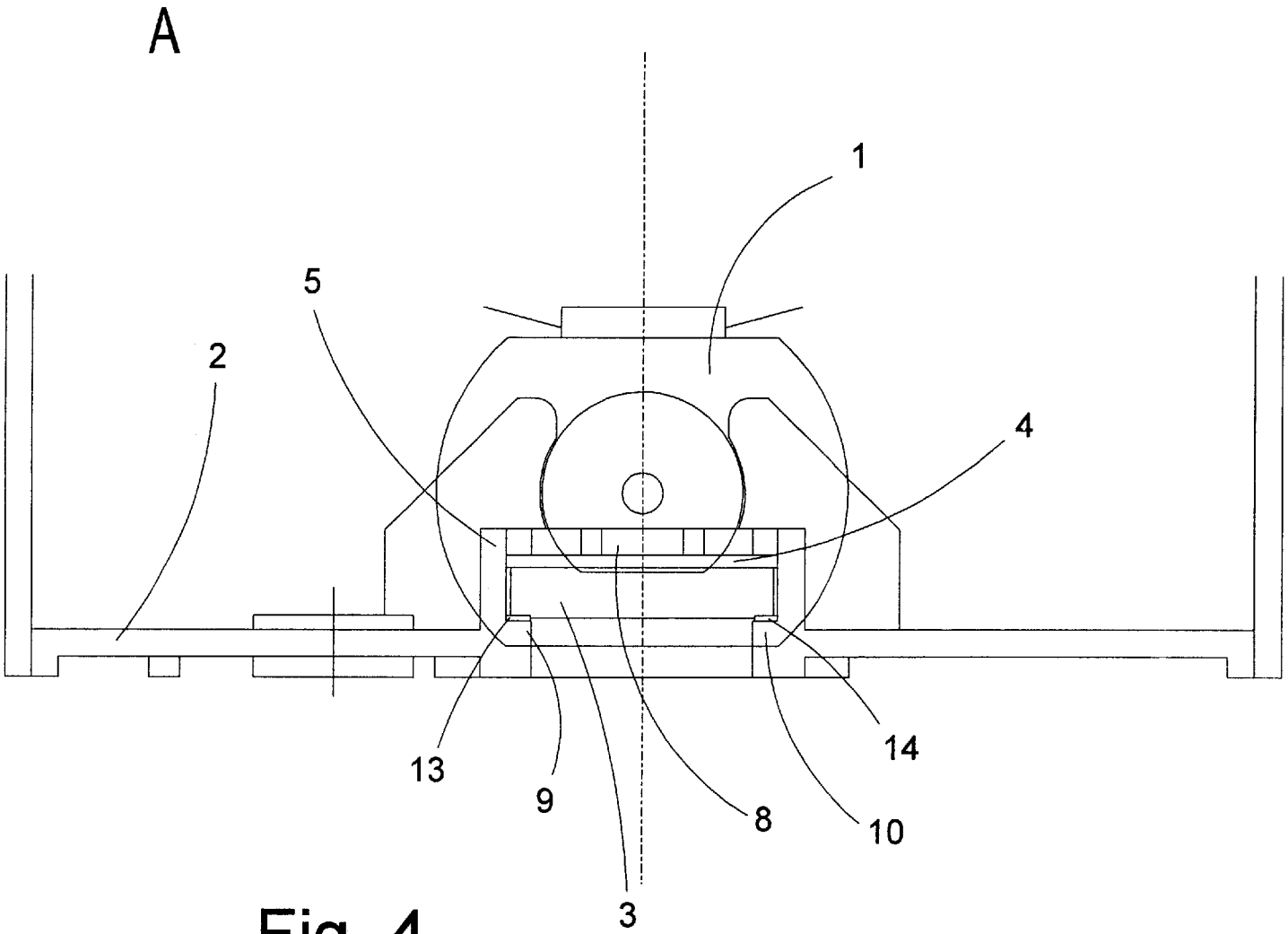
FIG. 4 shows a sectional view of an alternative embodiment of the toy car along line A of FIG. 1.
Figure 5:
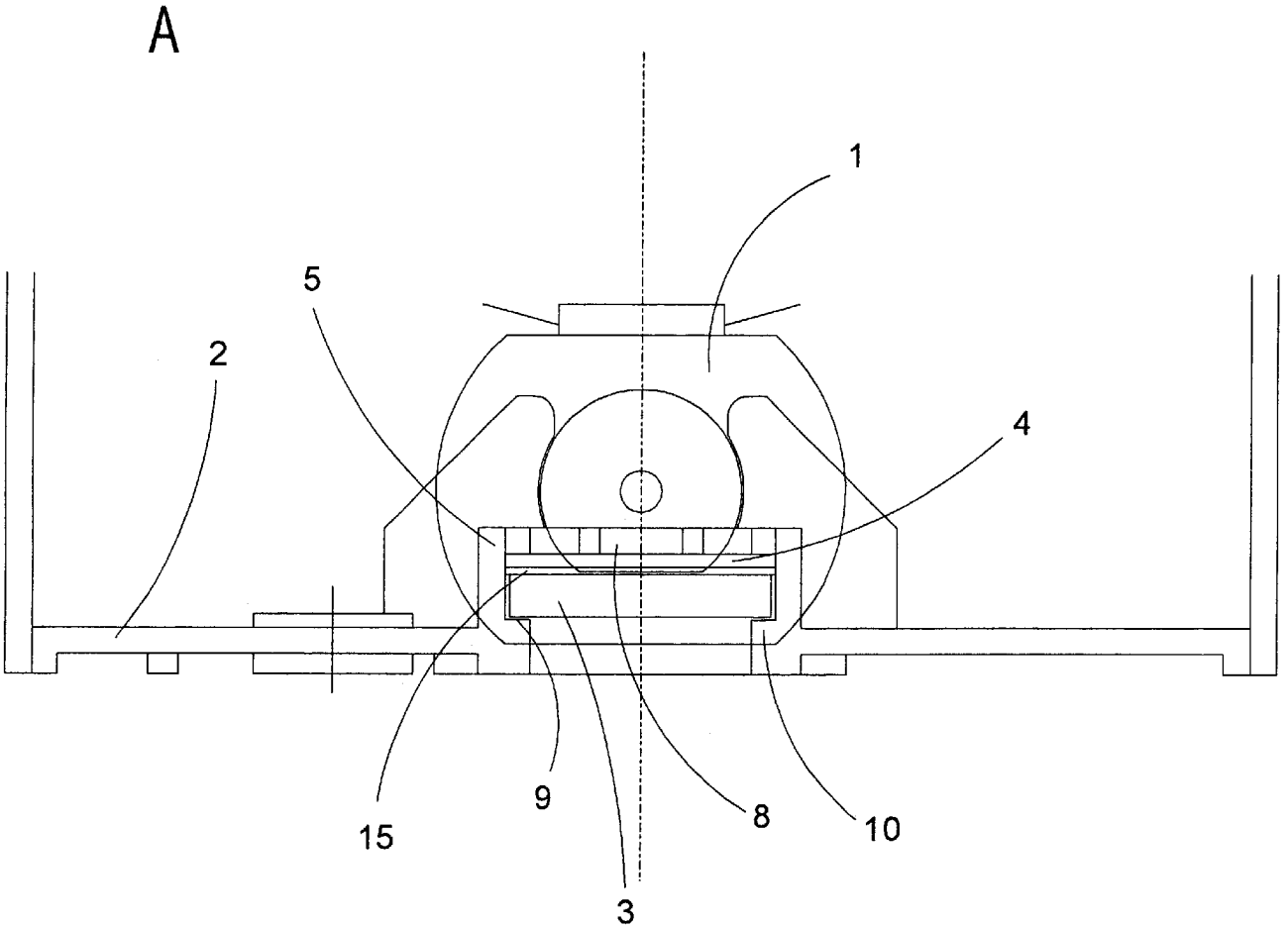
FIG. 5 shows a sectional view of another alternative embodiment of the toy car along line A of FIG. 1.

The permanent magnet can be shifted freely in retaining means 5. It is also possible to design guide rails 9, 10 and/or adhesion plate 4 respectively with raised structures as shown in FIGS. 4 and 5, in order to provide the user with feelable obstructions while shifting the permanent magnet, so that particular positions can be purposely selected as a kind of snap-in positions. Nevertheless, shifting is in principle infinitely variable.

In FIG. 4, the guide rails 9, 10 are provided with flexible protrusions 13, 14 to provide stop locations for permanent magnet 3. In FIG. 5, there is a perpendicular protrusion 15 on the adhesive plate 4, which also provides a stop location for permanent magnet 3.

By shifting permanent magnet 3 along the inclined plane of retaining means 5, one can vary not only the contact pressure of the toy car on the roadbed but also the running characteristic, since the force with which the toy car grips the roadbed is displaced forward when the permanent magnet is shifted forward.

Figure 6:
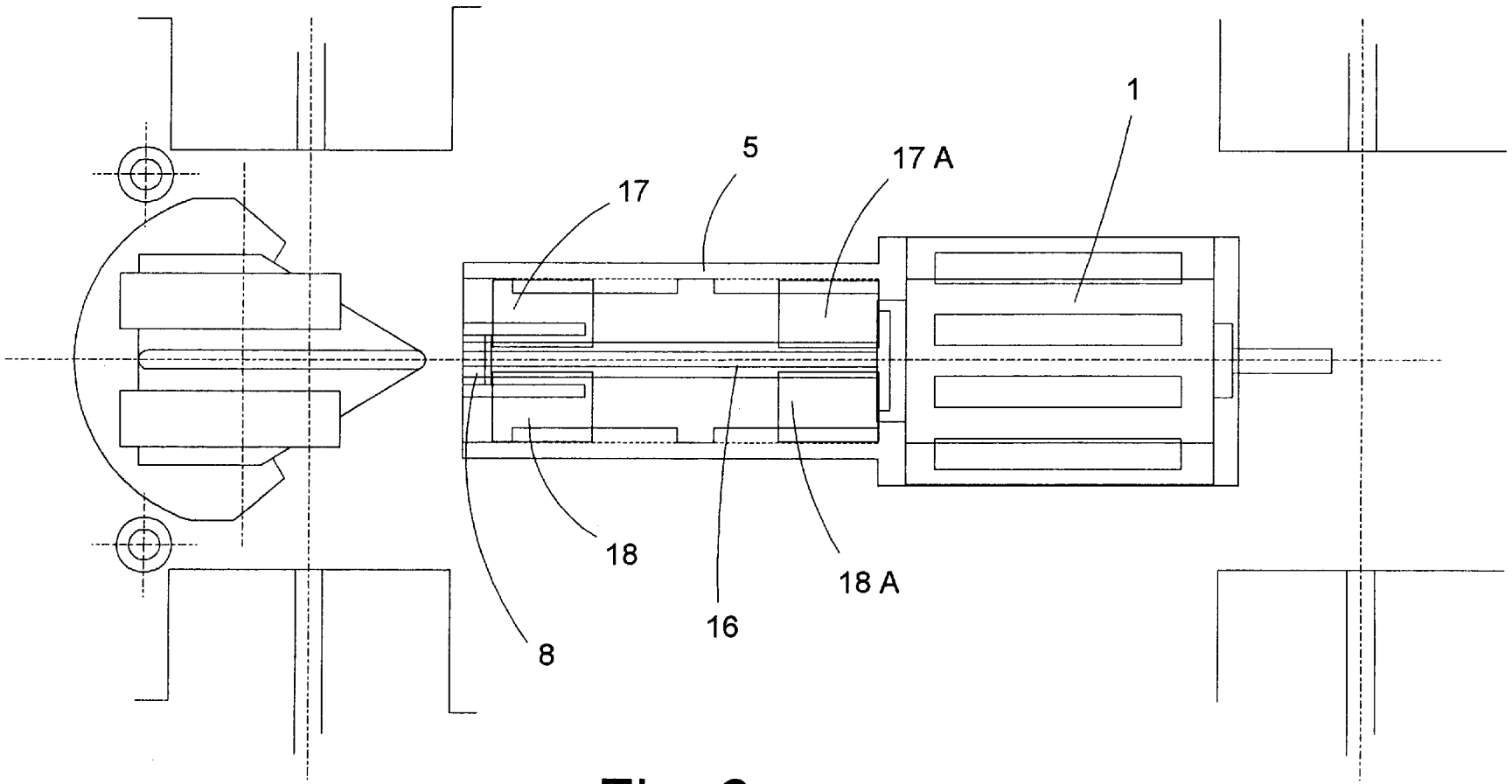
FIG. 6 shows a side view of yet another alternative embodiment of the toy car according to the invention.

In order to achieve finer adaptation of the running characteristics, it is also possible to design the rectangular permanent magnet as a two-piece structure, as shown in FIG. 6, so that the contact pressure is spread over a larger area of the roadbed. In FIG. 6, the magnet is divided into two pieces 17 and 18, which ride independently along a middle rail 16. The front position of magnets 17, 18 are shown as 17A, 18A. Fine adjustment of the contact pressure and of the running characteristic can be achieved by relative shifts of the parts 17, 18 of the permanent magnet.

Accordingly, while only a few embodiments of the present invention have been shown and described, it is obvious that many changes and modifications may be made thereunto without departing from the spirit and scope of the invention.

What is claimed is:

1. A toy car with adjustable magnetic adhesion for an auto racetrack having ferromagnetic current conductors countersunk in the roadbed, comprising:

a chassis;

a retaining means formed in one piece with the chassis;

a ferromagnetic adhesion plate oriented at an angle relative to a roadway plane to form an inclined plane, and received in said retaining means;

two lateral guide rails disposed on an underside of the retaining means; and a permanent magnet being infinitely variably shiftable in the chassis between the guide rails and the adhesion plate along the inclined plane in order to adjust the clearance between said permanent magnet and current conductors of the roadbed when the toy car is placed on the roadbed.

2. A toy car according to claim 1, wherein the retaining means is located in the chassis between a drive motor and front wheels.

3. A toy car according to claim 1, wherein the retaining means is provided with a holding nose which can be deflected at its front end in order to immobilize the adhesion plate.

4. A toy car according to claim 1, wherein the permanent magnet is constructed as a rectangular plate, which is shifted along the inclined plane by manual action from underneath the chassis.

* * * * *